US007557321B2

(12) United States Patent
Arataki et al.

(10) Patent No.: US 7,557,321 B2
(45) Date of Patent: Jul. 7, 2009

(54) TRIGGER SWITCH

(75) Inventors: Akihiro Arataki, Kurayoshi (JP); Yasushi Kamihashi, Tottori-ken (JP); Hidemi Nakamura, Tottori-ken (JP)

(73) Assignee: OMRON Corporation, Kyoto (JP)

( * ) Notice: Subject to any disclaimer, the term of this patent is extended or adjusted under 35 U.S.C. 154(b) by 0 days.

(21) Appl. No.: 12/055,960

(22) Filed: Mar. 26, 2008

(65) Prior Publication Data

US 2008/0314721 A1 Dec. 25, 2008

(30) Foreign Application Priority Data

Mar. 28, 2007 (JP) ..... 2007-085020

(51) Int. Cl.
*H01H 13/02* (2006.01)

(52) U.S. Cl. ..... 200/522

(58) Field of Classification Search ..... 200/6 R–6 BA, 200/43.16, 43.17, 520, 1 B, 522, 529, 533, 200/534, 332.1, 332.2, 329; 173/170; 310/50; 361/704

See application file for complete search history.

(56) References Cited

U.S. PATENT DOCUMENTS 4,523,176 A * 6/1985 Leibinger et al. ..... 338/179
4,553,005 A * 11/1985 Glenn ..... 200/522
4,572,997 A * 2/1986 Yamanobe et al. ..... 388/840
6,104,105 A 8/2000 Schaeffeler et al.
6,749,028 B1 * 6/2004 Chan et al. ..... 173/170
6,794,594 B2 * 9/2004 Ching ..... 200/522
7,297,891 B2 * 11/2007 Omori et al. ..... 200/522

FOREIGN PATENT DOCUMENTS

JP 6-290665 A 10/1994
JP 8-28146 B2 3/1996

OTHER PUBLICATIONS

English abstract of JP6290665 published Oct. 18, 1994, esp@cenet database, 1 page.

* cited by examiner

*Primary Examiner*—Michael A Friedhofer
(74) *Attorney, Agent, or Firm*—Osha • Liang LLP

(57) ABSTRACT

A trigger switch has a chassis, a slide member slidably retained in the chassis, a trigger connected to the slide member and projected from the chassis, the trigger configured to slide the slide member when the trigger is drawn towards the chassis, a pair of power-supply connecting terminals connected to a power supply, a pair of motor output terminals connected to a motor, a speed control circuit configured to output a current to the motor output terminal while controlling the current when the speed control circuit is connected to the power supply, a first contact mechanism configured to connect the power-supply connecting terminal to the speed control circuit when the trigger is drawn by a first amount; and a second contact mechanism configured to connect the power-supply connecting terminal to the motor output terminal when the trigger is drawn by a second amount.

4 Claims, 6 Drawing Sheets

TRIGGER SWITCH

BACKGROUND OF THE INVENTION

1. Field of the Invention

The present invention relates to a trigger switch used in electric tools.

2. Description of the Related Art

Conventionally, there is widely used a trigger switch disposed in a grip portion of the electric tool, which a user draws with a finger to start up the electric tool.

As disclosed in Japanese Patent Publication No. 1996-28146 and U.S. Pat. No. 6,104,105, there is well known a trigger switch in which a seesaw type contact pair is operated using a slide member slid by manipulation of a trigger. The seesaw type contact pair includes a movable piece, an arm portion, and a lever portion. A center portion of the movable piece is supported, and the movable piece is extended from a fulcrum toward a direction in which the trigger is drawn. A movable contact is located at a front end of the movable piece, and the movable contact touches on a fixed contact provided outside the movable piece. The arm portion is biased by a spring such that the movable contact touches on the fixed contact. The lever portion is extended on the opposite side to the arm portion, the lever portion touches on the slide member to be widened outward, and the lever portion inwardly rotates the arm portion against a biasing force of the spring.

Miniaturization of the trigger switch is needed to improve operability of the electric tool. When a helical spring draws the movable piece to bias the movable piece as shown in FIG. 1 of Japanese Patent Publication No. 1966-28146, the trigger switch cannot be miniaturized because the helical spring is extended off the outside of the fixed contact.

In the case where the movable piece is biased from the inside by a compression spring, it is necessary that a spring seat to which one end of the compression spring is fixed be formed outside a guide structure of the slide member or the spring biasing the trigger. When the trigger switch is miniaturized as shown in FIG. 2 of U.S. Pat. No. 6,104,105, it is necessary that the spring be shortened during compression in order to ensure a stroke of the contact. Therefore, unfortunately reliability is lowered because sufficient pressure-contact force cannot be obtained to the fixed contact.

SUMMARY OF THE INVENTION

In one or more embodiments of the present invention, a trigger switch is miniaturized while the reliability of the contact mechanism is enhanced.

In one or more embodiments of the present invention, a trigger switch of the present invention includes a chassis; a slide member which is slidably retained in the chassis; a trigger which is connected to the slide member and projected from the chassis, the trigger sliding the slide member by drawing the trigger towards the chassis; a pair of power-supply connecting terminals which is connected to a power supply; a pair of motor output terminals which is connected to a motor; a speed control circuit which outputs a current to the motor output terminal while controlling the current, when the speed control circuit is connected to the power supply; a first contact mechanism which is closed to connect the power-supply connecting terminal to the speed control circuit by sliding the slide member, when the trigger is drawn by a small amount; and a second contact mechanism which is closed to connect the power-supply connecting terminal to the motor output terminal by sliding the slide member, when the trigger is drawn by a large amount, wherein each of the first contact mechanism and the second contact mechanism includes a movable piece and a fixed contact, the movable piece being formed by a swingably-supported metal plate, the fixed contact being able to abut on the movable piece, the movable piece includes a support portion, an arm portion, and a lever portion, the support portion being swingably supported, the arm portion being extended from the support portion, a movable contact abutting on the fixed contact being provided at a front end of the support portion, a spring seat being provided in an intermediate portion of the support portion, the spring seat receiving one end of a compression spring, the compression spring biasing the spring seat such that the support portion is separated from and brought into contact with the slide member, the lever portion being extended from the support portion toward an opposite side to the arm portion, the lever portion being able to abut on the slide member, and steps are formed in front of and at the back of the spring seat in the arm portion, the arm portion being bent such that the spring seat is recessed toward an opposite side to the slide member.

Accordingly, the arm portion is bent to form steps so that the spring seat is kept away from the slide member. The length of the compression spring can therefore be increased to obtain a proper biasing force. In consideration of electric characteristics and friction of the contact, members made of copper or the like are used as the fixed contact and movable contact while projected. Therefore, the spring seat is projected in a dead space corresponding to a height of the movable contact existing between the movable piece and the chassis, so that a stroke of the compression spring can be ensured without upsizing the trigger switch.

Further, in the trigger switch according to one or more embodiments of the invention, the arm portion is extended toward a side on which the trigger is drawn.

Accordingly, the movable piece can be brought into contact with the fixed contact to close the circuit when the trigger is drawn.

Further, in the trigger switch according to one or more embodiments of the invention, the lever portion is bent and extended toward the slide member.

Accordingly, the trigger switch can be miniaturized because the lever portion is not projected outward when the contact is opened.

According to one or more embodiments of the invention, the arm portion of the movable piece of the trigger switch is bent to project the spring seat of the compression spring into the dead space generated by a thickness of the contact, so that the compression spring can be lengthened to obtain a proper biasing force without upsizing the trigger switch.

DETAILED DESCRIPTION OF THE PREFERRED EMBODIMENT

Figure 1:
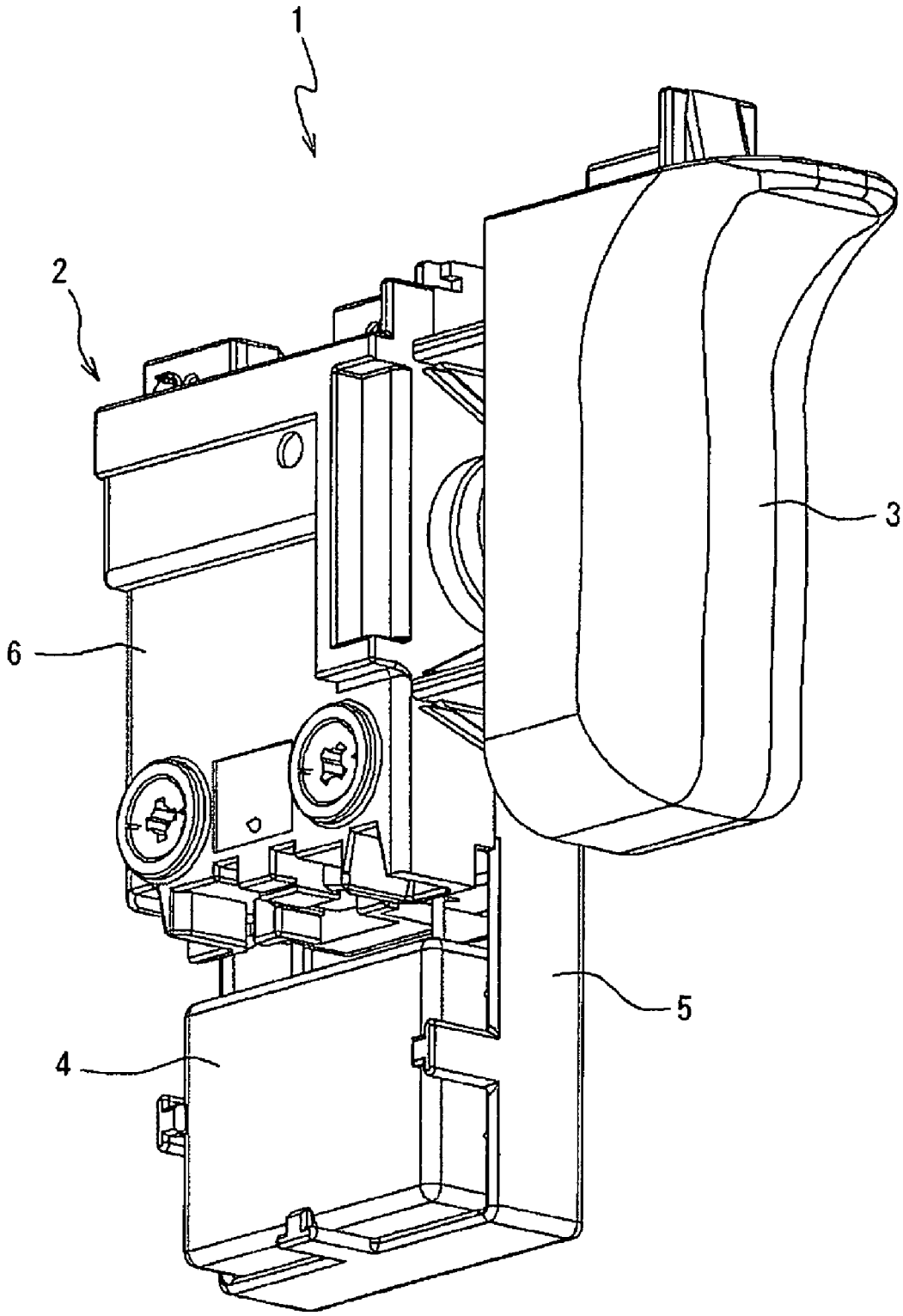
FIG. 1 shows a perspective view of a trigger switch according to an embodiment of the invention.

An embodiment of the invention will be described below with reference to the drawings. FIG. 1 shows an appearance of a trigger switch 1 according to an embodiment of the invention. In the trigger switch 1, a trigger 3 and a capacitor 4 are provided in a main body 2. The main body 2 is formed of a chassis 5 sealed with a cover 6.

Figure 2:
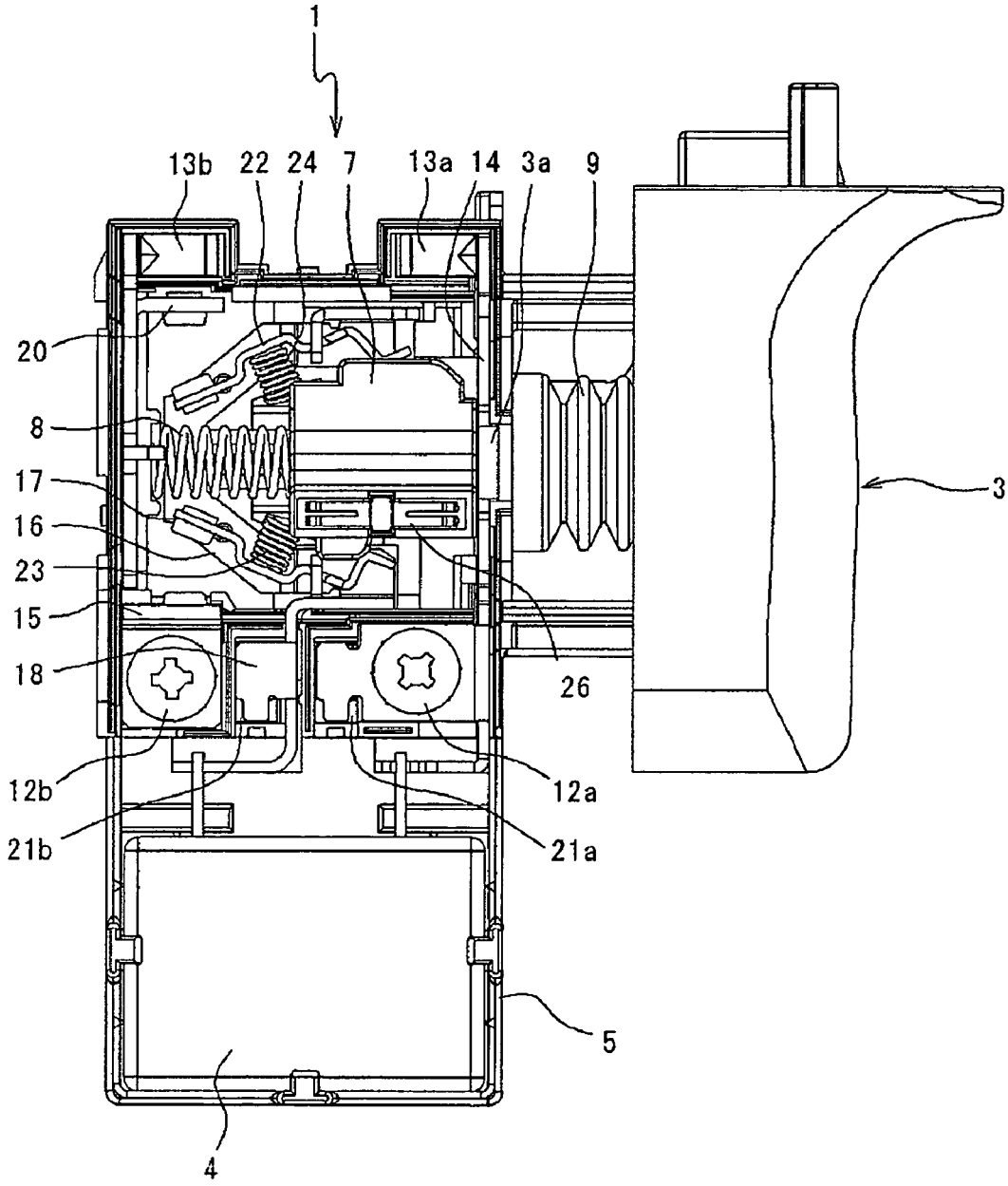
FIG. 2 shows a front view illustrating a state in which a cover of the trigger switch of FIG. 1 is taken out.
Figure 3:
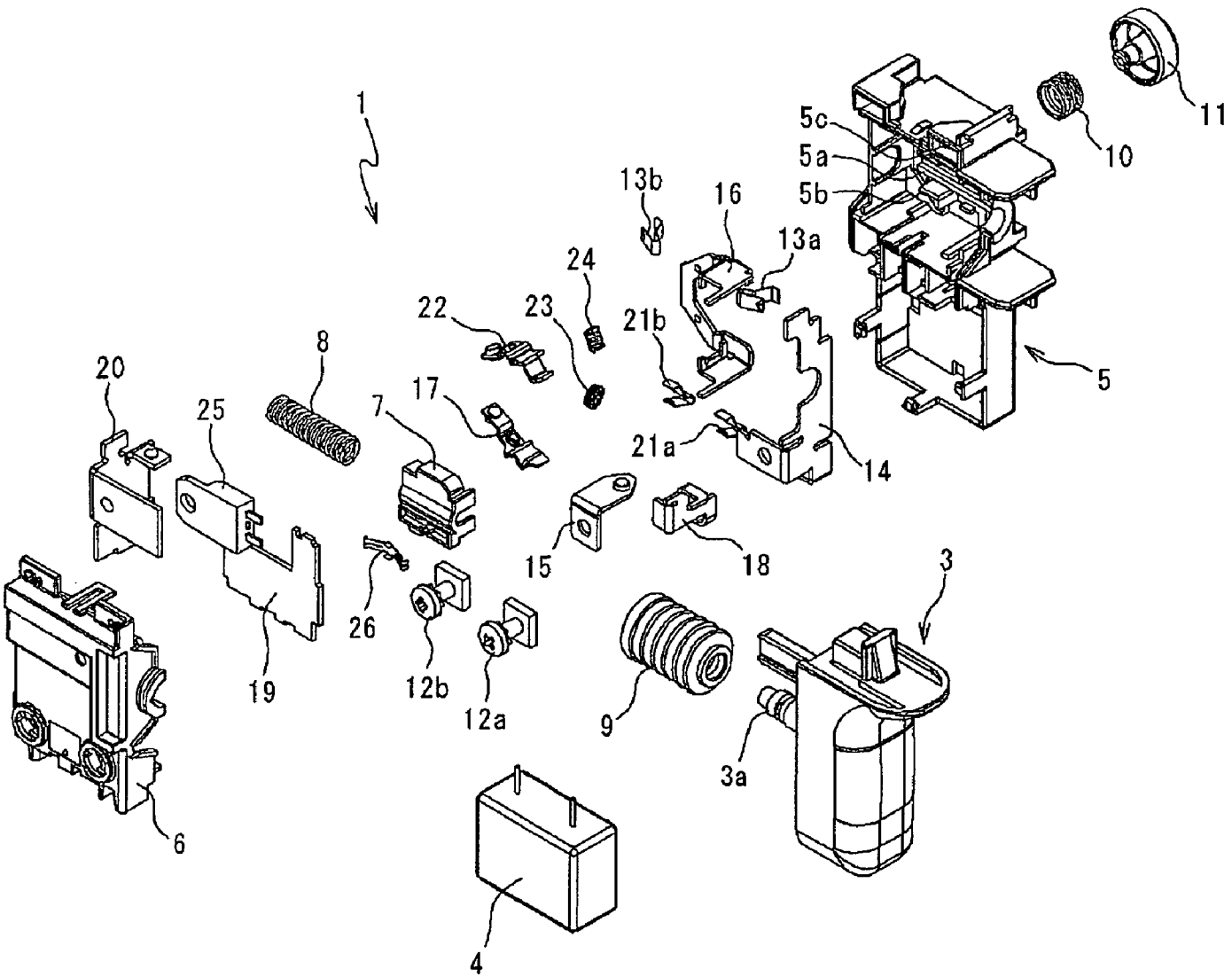
FIG. 3 shows an exploded perspective view of the trigger switch of FIG. 1.

FIG. 2 shows a state in which the cover 6 of the trigger switch 1 of FIG. 1 is taken out, and FIG. 3 shows a state in which the trigger switch 1 is disassembled. In the trigger 3, a shaft portion 3*a* is extended into the chassis 5 and connected to a slide member 7 which can be slid in the chassis 5, and a trigger biasing spring 8 biases the shaft portion 3*a* toward a direction in which the shaft portion 3*a* is protruded from the chassis 5. A dust-proof cover 9 is attached to the shaft portion 3*a* of the trigger 3 in order to seal a gap between the shaft portion 3*a* and the chassis 5.

When a user draws the trigger 3 against a biasing force of the trigger biasing spring 8, the slide member 7 is slid in the chassis 5 while being integral with the trigger 3. Even if the user releases the force applied to the trigger 3, the slide member 7 is slid in the chassis 5 while being integral with the trigger 3 returned by the biasing force of the trigger biasing spring 8.

As shown in FIG. 3, a lock button 11 is biased so as to be protruded from the chassis 5 by a lock spring 10. When the lock button 11 is pushed, the trigger switch 1 can be locked while the trigger 3 is drawn.

In the trigger switch 1, an alternating-current power supply is connected to power-supply connecting terminals 12*a* and 12*b*, and a current can be outputted to motor output terminals 13*a* and 13*b*.

The power-supply connecting terminal 12*a* and the motor output terminal 13*a* are connected by a metal electrically-conducting path member 14. On the other hand, the power-supply connecting terminal 12*b* is connected to an electrically-conducting path member 15, and a movable piece 17 is supported by an electrically-conducting path member 16 buts on the electrically-conducting path member 15, whereby the power-supply connecting terminal 12*b* is connected to a speed control circuit board 19 through the movable piece 17, the electrically-conducting path member 16, and an electrically-conducting path member 18. An output of the speed control circuit board 19 is connected to the motor output terminal 13*b* through an electrically-conducting path member 20.

In the electrically-conducting path member 16, a movable piece 22 supported in an upper portion thereof can contact the electrically-conducting path member 20 to bypass the speed control circuit board 19.

An external output terminal 21*a* and an external output terminal 21*b* are provided in the trigger switch 1. The external output terminal 21*a* is connected to the power-supply connecting terminal 12*a*, and the external output terminal 21*b* is connected to the electrically-conducting path member 18. The external output terminals 21*a* and 21*b* can supply electric power to the outside when a voltage is outputted between the motor output terminals 13*a* and 13*b*. The capacitor 4 is connected between the power-supply connecting terminal 12*a* and the electrically-conducting path member 18.

The movable piece 17 and the movable piece 22 are swingably supported by the electrically-conducting path member 16, and the movable pieces 17 and 22 are biased by compression springs 23 and 24 toward directions in which the movable pieces 17 and 22 abut on the electrically-conducting path members 15 and 20 respectively.

A printed circuit is formed in the speed control circuit board 19, and plural electronic components including a thyristor 25 are mounted on the speed control circuit board 19. The electrically-conducting path member 20 is also used as a radiator plate of the thyristor 25. A brush contact 26 retained by the slide member 7 abuts on a printed resistor of the speed control circuit board 19, and the brush contact 26 changes the output of the speed control circuit board 19 by slide movement in response to manipulation of the trigger 3.

Figure 4:
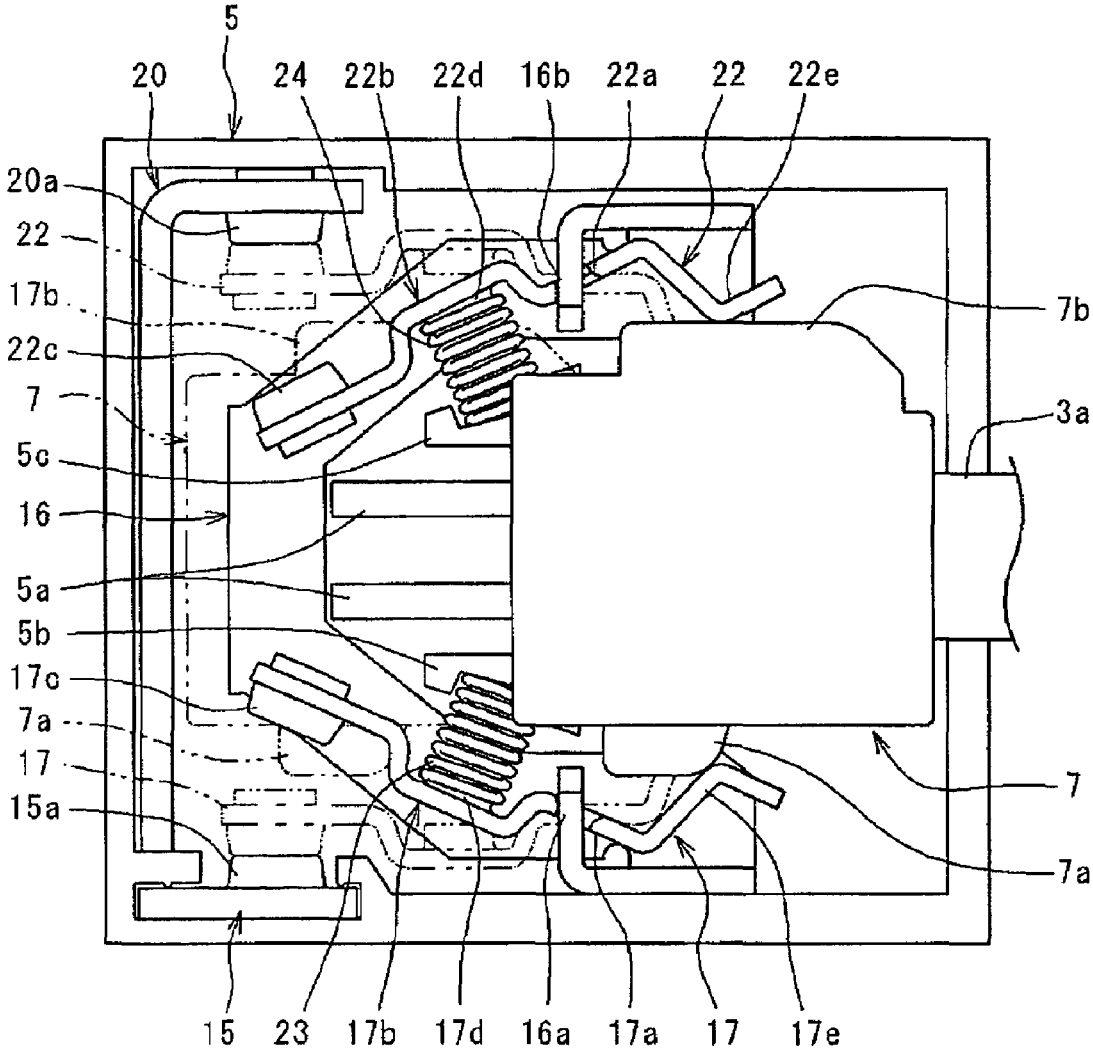
FIG. 4 is a partially front view of the trigger switch of FIG. 2.

FIG. 4 shows a relationship among the slide member 7, the electrically-conducting path members 15, 16, and 20, and the movable pieces 17 and 22. The slide member 7 is slid along a guide portion 5*a* of the chassis 5. In the electrically-conducting path member 16, while bypassing the guide portion 5*a* of the chassis 5, both ends are extended to the vertical directions of the range where the slide member 7 is moved to swingably support the movable pieces 17 and 22.

Figure 5:
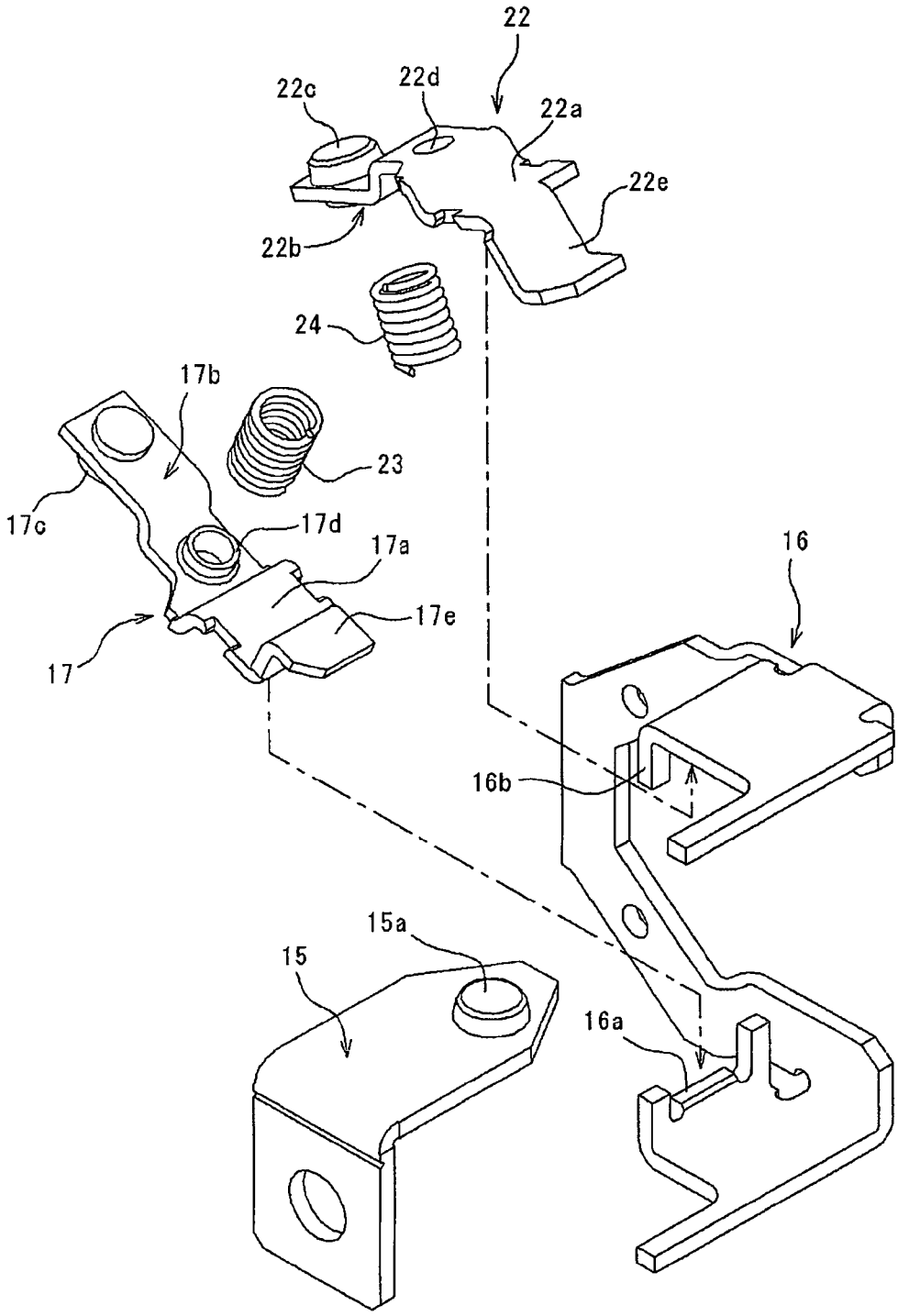
FIG. 5 shows an exploded perspective view illustrating a contact mechanism of the trigger switch of FIG. 1.

As shown in FIG. 5, the movable pieces 17 and 22 are formed by pressing a metal plate, support portions 17*a* and 22*a* in which notches are provided on both sides are supported by engaging receiving portions 16*a* and 16*b*. The receiving portions 16*a* and 16*b* are inwardly provided in upper and lower portions of the electrically-conducting path member 16 while facing each other.

The movable pieces 17 and 22 include arm portions 17*b* and 22*b* which are extended from the support portions 17*a* and 22*a* toward the side on which the trigger 3 is drawn. Movable contacts 17*c* and 22*c* are attached onto the outside (opposite side to slide member 7) at the front end of the arm portions 17*b* and 22*b*. The movable contacts 17*c* and 22*c* ensures electrical conductivity by abutting the fixed contacts 15*a* and 20*a* provided in the electrically-conducting path member 15 and 20. Spring seats 17*d* and 22*d* engaging compression springs 23 and 24 are formed in an intermediate portion of the arm portions 17*b* and 22*b*.

As shown in FIG. 4, in the compression springs 23 and 24, one end engages each of the spring seats 17*d* and 22*d* of the movable pieces 17 and 22, and the other end is received by each of the spring supports 5*b* and 5*c* which are formed in the chassis 5 so as not to interfere with the slide member 7. The spring supports 5*b* and 5*c* are grooves opened onto the side of the cover 6. The slide member 7 is assembled to the spring supports 5*b* and 5*c*, and the slide member 7 pressurizes the compression springs 23 and 24 so as not to drop off from the spring supports 5*b* and 5*c*.

The movable pieces 17 and 22 also include lever portions 17*e* and 22*e* respectively. The lever portions 17*e* and 22*e* are extended in a bending manner from the support portions 17*a* and 22*a* toward the slide member 7 provided on the opposite side to the arm portions 17*b* and 22*b*. The lever portions 17*e* and 22*e* abut on manipulation portions 7*a* and 7*b* which are provided in the slide member 7 while projected from the slide member 7. The lever portions 17*e* and 22*e* rotates the movable pieces 17 and 22 against the biasing forces of the compression springs 23 and 24 to separate and bring the movable contacts 17*c* and 22*c* of the arm portions 17*b* and 22*b* from and into contact with the fixed contacts 15*a* and 20*a* of the electrically-conducting path member 15 and 20.

Figure 6:
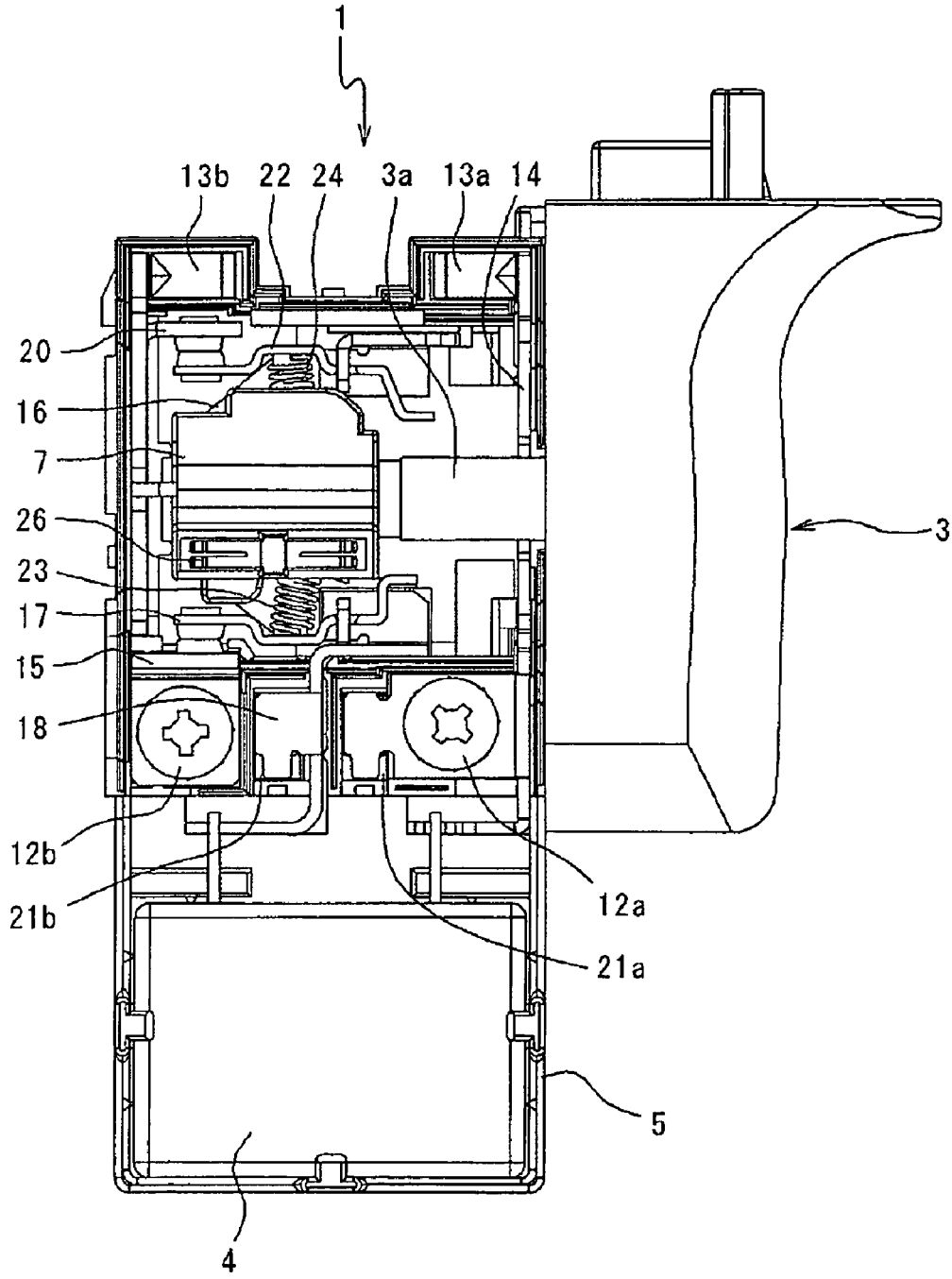
FIG. 6 shows a front view illustrating a state in which a trigger of the trigger switch of FIG. 1 is drawn.

As shown in FIG. 6, when the trigger 3 is drawn, the slide member 7 is moved, whereby the manipulation portion 7*a* and 7*b* are moved to positions where the manipulation portion 7*a* and 7*b* does not abut on the lever portions 17*e* and 22*e*. Therefore, the movable piece 17 and 22 are rotated by the biasing forces of the compression springs 23 and 24 to cause the movable contacts 17*c* and 22*c* of the arm portions 17*b* and 22*b* to abut on the fixed contacts 15*a* and 20*a* of the electrically-conducting path members 15 and 20.

In the trigger switch 1, when the trigger 3 is drawn by about 1.6 mm, the manipulation portion 7*a* disengages the lever portion 17*e*, and the movable contact 17*c* is brought into contact with the fixed contact 15*a* to electrically connect the electrically-conducting path member 15 and the movable piece 17 (first contact mechanism). Therefore, the speed control circuit board 19 is connected to the power-supply connecting terminal 12*b*, and the power-supply voltage is applied between both ends of the capacitor 4 and between the external output terminals 21*a* and 21*b*. When the trigger 3 is drawn by the total of about 2.6 mm, the brush contact 26 abuts on the printed resistor of the speed control circuit board 19, and the speed control circuit board 19 starts the current output. The speed control circuit board 19 controls the output such that the output current is increased with increasing drawn amount of the trigger 3. When the trigger 3 is drawn by the total of about 7.0 mm, the manipulation portion 7*b* disengages the lever portion 22*e*, and the movable contact 22*c* is brought into contact with the fixed contact 20*a* to electrically connect the electrically-conducting path member 20 and the movable piece 22 (second contact mechanism). Therefore, the power-supply connecting terminal 12*b* is directly connected to the motor output terminal 13*b* while bypassing the speed control circuit board 19, thereby rotating the motor at full speed. The trigger 3 can finally be drawn by the total of about 9.4 mm.

The steps are formed in front of and at the back of the spring seats 17*d* and 22*d* in the arm portions 17*b* and 22*b* of the movable pieces 17 and 22 of the embodiment, the arm portions 17*b* and 22*b* are bent, and the arm portions 17*b* and 22*b* are recessed so as to keep the spring seats 17*d* and 22*d* away from the slide member 7. Therefore, in the trigger switch 1, the distances are increased between the spring seats 17*d* and 22*d* and spring supports 5*b* and 5*c*. Accordingly, the lengths of the compression springs 23 and 24 can be increased although the distances between the movable contacts 17*e* and 22*e* and the fixed contacts 15*a* and 20*a* are sufficiently ensured in the state in which the trigger 3 is returned.

The spring having a sufficiently large spring constant can be used as the compression springs 23 and 24 by lengthening the compression springs 23 and 24, and a change in biasing force can be decreased in the swing ranges of the movable pieces 17 and 22. Therefore, contact pressures of the movable contacts 17*e* and 22*e* to the fixed contacts 15*a* and 20*a* can be increased to ensure the electrically-conducting contact between the arm portions 17*b* and 22*b* and the electrically-conducting path member 15 and 20.

Generally it is necessary that the movable contacts 17*c* and 22*c* and the fixed contacts 15*a* and 20*a* have a certain height in consideration of friction, and a dead space is generated with a sidewall of the chassis 5 in the outside (opposite side to slide member 7) of the arm portions 17*b* and 22*b*. In one or more embodiments of the invention, the intermediate portion of the arm portions 17*b* and 22*b* are projected in the dead space, and the spring seats 17*d* and 22*d* are outwardly recessed without occupying an excessive space. Therefore, the upsizing of the trigger switch 1 can be suppressed.

Thus, according to one or more embodiments of the invention, the arm portions 17*b* and 22*b* of the movable pieces 17 and 22 are bent outward, so that the reliability of the seesaw type contact can be enhanced without upsizing the chassis 5.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A trigger switch comprising:

a chassis;

a slide member slidably retained in the chassis;

a trigger connected to the slide member and projected from the chassis, the trigger configured to slide the slide member when the trigger is drawn towards the chassis;

a pair of power-supply connecting terminals connected to a power supply;

a pair of motor output terminals connected to a motor, a speed control circuit configured to output a current to the motor output terminal while controlling the current when the speed control circuit is connected to the power supply;

a first contact mechanism configured to connect the power-supply connecting terminal to the speed control circuit when the trigger is drawn by a first amount; and a second contact mechanism configured to connect the power-supply connecting terminal to the motor output terminal when the trigger is drawn by a second amount, wherein each of the first contact mechanism and the second contact mechanism includes a movable piece and a fixed contact, the movable piece being formed by a swingably-supported metal plate, and the fixed contact being able to abut on the movable piece, the movable piece includes a support portion, an arm portion, and a lever portion, the support portion being swingably supported, the arm portion extending from the support portion, a movable contact being provided at a front end of the support portion, the movable contact being configured to abut the fixed contact, a spring seat being provided in an intermediate portion of the support portion, the spring seat receiving one end of a compression spring, the compression spring biasing the spring seat such that the support portion is separated from and brought into contact with the slide member, the lever portion being extended from the support portion toward an opposite side to the arm portion, the lever portion configured to abut on the slide member, and steps are formed in front of and at the back of the spring seat in the arm portion, the arm portion being bent such that the spring seat is recessed toward an opposite side to the slide member.

2. The trigger switch according to claim 1, wherein the arm portion is extended toward a side on which the trigger is drawn.

3. The trigger switch according to claim 1, wherein the lever portion is bent and extended toward the slide member.

4. The trigger switch according to claim 2, wherein the lever portion is bent and extended toward the slide member.

* * * * *